US005572176A

United States Patent [19]

Heinzl et al.

[11] Patent Number: 5,572,176

[45] Date of Patent: Nov. 5, 1996

[54] RELAY HAVING A MOVABLE SLIDE AND METHOD FOR THE MANUFACTURE THEREOF

[75] Inventors: Alfred Heinzl; Heinz Stadler, both of Munich, Germany

[73] Assignee: Siemens Aktiengesellschaft, Munich, Germany

[21] Appl. No.: 385,694

[22] Filed: Feb. 8, 1995

[30] Foreign Application Priority Data

Feb. 18, 1994 [DE] Germany ..... 44 05 222.7

[51] Int. Cl.[6] ..... H01H 51/22

[52] U.S. Cl. ..... 335/129; 335/131

[58] Field of Search ..... 335/78–86, 124, 335/128, 129, 130

[56] References Cited

U.S. PATENT DOCUMENTS 3,800,252 3/1974 Aigner .
4,618,842 10/1986 Nestlen et al. .
4,958,137 9/1990 Schroeder ..... 335/128
5,396,204 3/1995 Matsuoka et al. ..... 335/78

FOREIGN PATENT DOCUMENTS 1061441 12/1959 Germany .

*Primary Examiner*—Lincoln Donovan
*Attorney, Agent, or Firm*—Hill, Steadman & Simpson

[57] ABSTRACT

An improved relay of conventional design is disclosed wherein the relay has an armature and at least one moveable contact element. A slide is attached to the armature and moveable contact element. The slide is of a length matched to the actual distance between the armature and the moveable contact element after the armature and moveable contact element are secured to a base and moved to a contact position.

7 Claims, 3 Drawing Sheets

RELAY HAVING A MOVABLE SLIDE AND METHOD FOR THE MANUFACTURE THEREOF

BACKGROUND OF THE INVENTION

1. Field of the Invention

The present invention is directed to an improved relay having an armature, and at least one moveable contact element with an elongated slide for the transmission of the armature movement to the movable contact element. An improved method of manufacturing the relay is also disclosed.

2. Description of the Related Art

Relays having a slide for transmission of the switch motion, are generally known in the art. For example, German patent application DE-A-38 35 115 shows such a relay with an elongated, rod-shaped slide that is fabricated to a rigidly prescribed length. In such relays, tolerances due to the fabrication of the individual parts and the assembly thereof add so that relays of this type must often be adjusted after assembly to assure that the armature stroke also leads to the desired switch motion at the contact elements and also results in the production of a predetermined contact force. In traditional relays, the adjustment can be undertaken, for example, by a bending at the armature end or at the contact elements. The desired setting is thereby usually only achieved in a plurality of steps each with an intervening measurement. These adjustment procedures are difficult to automate. Furthermore, these procedures cannot be integrated into a normal manufacturing production line because the relay must be measured and readjusted multiple times.

German Letters Patent 10 61 441 also discloses a relay wherein the slide is of fixed length and is attached to the armature by an adjustable screw. Such an adjustment, however, requires not only extensive manual work but also requires a design that can no longer be justified in mass production.

Thus there remains a need in the art for a relay which is both reliable and easy to manufacture and which also does not require repeated adjustment and calibration in the manufacturing process.

One object of the present invention is thus to manufacture a relay wherein the adjustment for compensating manufacturing tolerances can be easily incorporated into the normal fabrication sequence. Another object of the present invention is to provide a relay which does not require multiple measurement and re-adjustment. Other objects and advantages of the present invention will become apparent from the following summary and detailed description of the present invention.

SUMMARY OF THE INVENTION

In the relay of the present invention, the length of the slide is individually matched to the actual spacing between the armature and the movable switch contact based on the manufacturing tolerances for a predetermined switch status.

In the relay of the present invention, the armature or contact springs are not adapted to the rigidly prescribed length of the slide after complete assembly by bending or in some other way; rather, the effective length of the slide is matched to the manufacturing and assembly tolerances of the functional parts for the relay.

The method for manufacturing such a relay comprises the following steps:

a) the functional elements of the relay, particularly the armature and the moveable contact element or, alternatively, the movable contact elements, are assembled in their final position without the slide;

b) the armature and every movable contact element are brought to a location corresponding to a given predetermined switch operating condition independently of one another;

c) the spacing between the armature and each movable contact element is then measured; and d) finally, the slide is produced with an effective length corresponding to the measured spacing which is then subsequently mounted.

The slide is easily manufactured by cutting off a section from a prefabricated, length or band of material. However, a formation of the slide is also possible, for example by impressing, enlarging or dimensioning a piece of sheet metal. Formation of a plastic slide can also be achieved through the use of ultrasound. The invention shall be set forth in greater detail below with reference to the following Detailed Description of the Preferred Embodiments and the drawings.

DETAILED DESCRIPTION OF THE PREFERRED EMBODIMENTS

Figure 1:
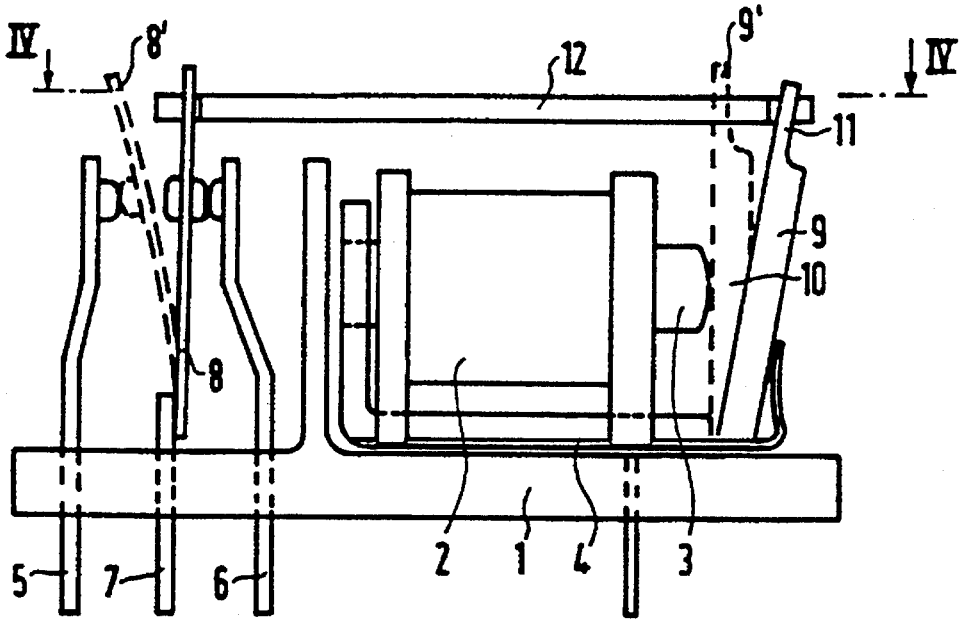
FIG. 1 illustrates a cross-sectional side view of a relay having an elongated slide.

The relay schematically shown in FIG. 1 has a base 1 on which a magnet system comprising a coil 2, a core 3 and a yoke 4 is provided. Stationary cooperating contact elements 5 and 6 as well as a terminal element 7 for a middle contact spring 8 are also secured to the base 1. The middle contact spring 8 forms a switch-over contact or change-over contact together with the two cooperating contact elements 5 and 6. An armature 9 seated at the yoke 4 forms a working air gap together with the end of the core 3 and actuates the middle contact spring 8 with its free end 11 via an elongated, card-shaped or rod-shaped slide 12. Upon excitation of the magnet system, the armature assumes the position 9' shown with broken lines, and the middle contact spring 8 is switched into the position 8' shown with broken lines, i.e. from the break contact element 6 to the make contact element 5. A well known structure for a relay is thus employed in the present invention.

In order to compensate for the manufacturing tolerances of the individual parts and of their physical location, it is possible to bend the end 11 of the armature having the reduced cross section and to thus adjust it; it is also standard to adjust the stationary cooperating contact elements 5 and 6 and/or the middle contact spring 8 by bending.

Figure 2:
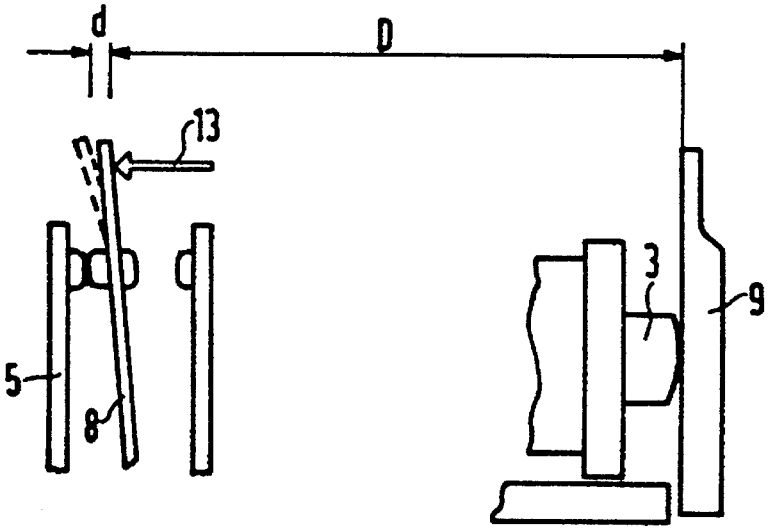
FIG. 2 is a cross-sectional side view illustrating the length measurement for the slide of the present invention.
Figure 3:
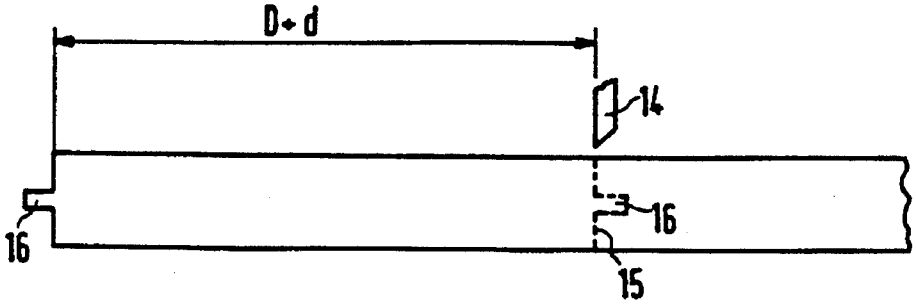
FIG. 3 illustrates the manufacture of the slide member of the present invention.

In manufacturing the relay of the invention, the effective length of the armature (without taking the retainer noses at the ends into consideration) is individually selected instead of using the traditional forms of adjustment. To this end, the relay of FIG. 1 is assembled without the slide 12. The system is then excited, for example as shown in FIG. 2, so that the armature 9 presses against the pole face of the core 3. At the same time, the middle contact spring 8 is moved into the make position with an auxiliary pin 13 suggested in the drawing until it touches the make contact element 5. The armature and switch are thus set to a predetermined switched condition. The distance D between the armature and the middle contact spring 8 is then measured at their respective engagement points on the slide. In order to calculate the effective slide length, an amount d for the excess stroke must then also be added. The middle contact spring 8 must continue to move by this amount after the making of the contact in order to generate the desired contact pressure. A slide is then manufactured with this slide dimension D+d for each assembled relay. According to FIG. 3, for example, the dimension D+d is cut off from a band along the cut line 15 with a cutter means 14. The noses 16 at the slide ends have no influence on the effective length of the slide and are therefore left out of consideration.

Figure 4:
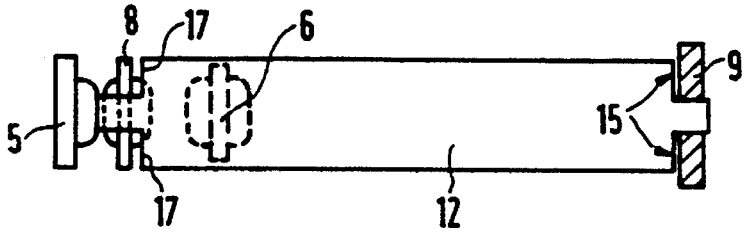
FIG. 4 is a plan view of a slide with an armature and a switch-over contact.
Figure 5:
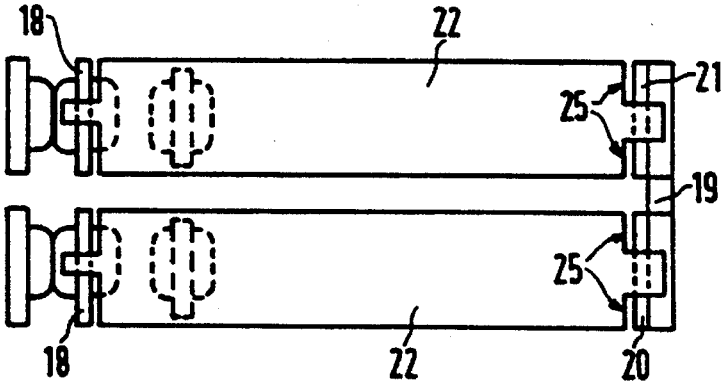
FIG. 5 a view corresponds to the embodiment of FIG. 4 but incorporates two slides and two switch-over contacts.
Figure 6:
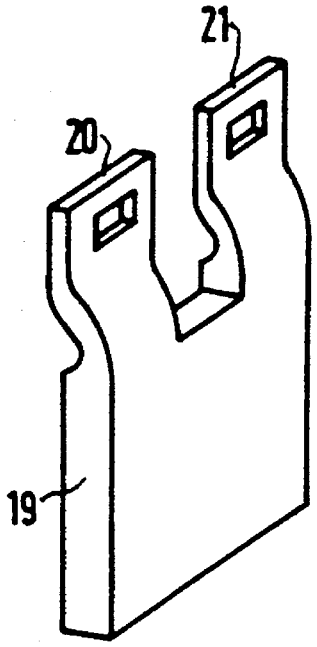
FIG. 6 is a perspective illustration of an armature for the embodiment of FIG. 5.
Figure 7:
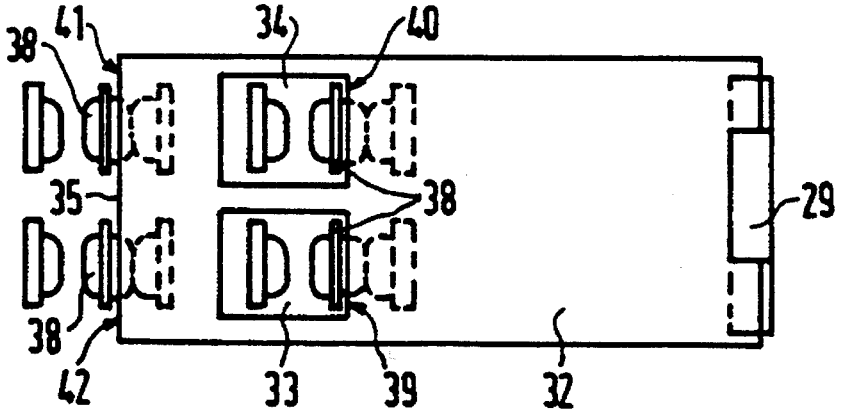
FIG. 7 is a plan view of a relay having one slide and four switch-over contacts.

Various contact and slide arrangements are shown in FIGS. 4, 5 and 7 in a plan view onto a relay according to FIG. 1. FIG. 4 shows the case illustrated in FIG. 1 with only one slide 12. As already set forth with reference to FIG. 3, the end edges 15 are cut in this case in order to obtain the effective slide length. Of course, the end edges 17 of the slide could also be cut at the opposite end for setting the length.

FIG. 5 schematically shows an embodiment having two change-over contacts arranged side-by-side. In this embodiment, two middle contact springs 18 lying side-by-side in a plane are actuated by two slides 22 that also this case, the armature 19 has two ends 20 and 21 lying side-by-side fork-like for actuating the two individual slides 22. Nonetheless, the required effective length is independently calculated for each of these slides 22 and is produced by separation at the cut line 25. An offset of the two armature ends 20 and 21 that is conditioned by manufacture can also be compensated in this way.

A multiple change-over relay, however, can also be operated with a single slide, as shown by way of example in FIG. 7 for four change-over contacts. In this case, a slide 32 is actuated via an armature 29, this slide 32 in turn actuating a total of four middle contact springs 38 via window cut-outs 33 and 34 with its free end 35. In the manufacture of this embodiment of the relay, the required slide length is then calculated for each of the middle contact springs 38 according to the principle of the invention, and these different lengths are taken into consideration in the manufacture of the slide by cutting the four actuation points or edges 39, 40, 41 and 42.

The synchronism of the contact springs can thus be assured by different trimming of the slide, particularly given multiple change-over relays.

The present invention is subject to many variations, modifications and changes in detail. It is intended that all matter described throughout the specification and shown in the accompanying drawings be considered illustrative only. Accordingly, it is intended that the invention be limited only by the scope of the appended claims.

We claim as our invention:

1. A relay comprising:

an armature;

at least one moveable contact element;

an elongated slide having first and second ends;

the first end of the elongated slide connected to the armature and the second end of the elongated slide connected to the moveable contact element wherein a length of the slide is matched to a distance between the armature and moveable contact element when the armature and moveable contact element are in a predetermined switch position; and an electromagnetic actuator for moving said armature, slide and moveable contact element to make and break an electrical contact, wherein the elongated slide is a common slide comprising a plurality of actuation points, each of the actuation points having a length matched to a distance between the armature and a corresponding moveable contact element when the armature and moveable contact element are in a predetermined switch position.

2. A method for manufacturing a relay comprising the steps of:

mounting an armature and at least one moveable contact element on a base;

moving the armature and the moveable contact element to a predetermined switch position;

measuring a distance between the armature and the moveable contact element;

providing a slide having a length corresponding to the distance between the armature and the moveable contact element; and attaching the slide to the armature and moveable contact element.

3. The method for manufacturing a relay of claim 2, wherein the length of the slide is calculated form a measured distance between the armature and moveable contact element in addition to a predetermined dimension for excess stroke.

4. A method for manufacturing a relay comprising the steps of:

mounting an armature and at least one moveable contact element on a base;

moving the armature and the moveable contact element to a predetermined switch position;

measuring a distance between the armature and the moveable contact element;

providing a slide having a length corresponding to the distance between the armature and the moveable contact element; and attaching the slide to the armature and moveable contact element wherein a distance between the armature and a plurality of moveable contact elements is individually measured and a corresponding plurality of slides are provided, each of the slides having a length corresponding to the measured distance from the armature to each of the corresponding ones of the plurality of moveable contact elements.

5. A method for manufacturing a relay comprising the steps of:

mounting an armature and at least one moveable contact element on a base;

moving the armature and the moveable contact element to a predetermined switch position;

measuring a distance between the armature and the moveable contact element;

providing a slide having a length corresponding to the distance between the armature and the moveable contact element;

attaching the slide the armature and moveable contact element; and measuring a distance between the armature and a plurality of moveable contact elements, wherein a single slide is provided having a length between the armature and each of a plurality of actuation points corresponding to each of the measured distances from the armature to each of the plurality of moveable contact elements.

6. The method of claim 4, wherein the step of providing a slide, comprises the step of cutting a plastic strip to a length corresponding to the distance between the armature and moveable contact element.

7. The method of claim 2, wherein the step of providing a slide, comprises the step of molding a plastic slide to a length corresponding to the distance between the armature and moveable contact element.

* * * * *